US011367371B2

(12) United States Patent
Xiong

(10) Patent No.: US 11,367,371 B2
(45) Date of Patent: Jun. 21, 2022

(54) DISPLAY PANEL AND DISPLAY DEVICE

(71) Applicant: HKC CORPORATION LIMITED, Guangdong (CN)

(72) Inventor: Zhi Xiong, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 97 days.

(21) Appl. No.: 17/043,984

(22) PCT Filed: Dec. 19, 2018

(86) PCT No.: PCT/CN2018/122187
§ 371 (c)(1),
(2) Date: Sep. 30, 2020

(87) PCT Pub. No.: WO2020/113690
PCT Pub. Date: Jun. 11, 2020

(65) Prior Publication Data

US 2021/0035482 A1 Feb. 4, 2021

(30) Foreign Application Priority Data

Dec. 5, 2018 (CN) ..... 201811484036.6

(51) Int. Cl.
*G09G 3/20* (2006.01)

(52) U.S. Cl.
CPC ..... *G09G 3/20* (2013.01); *G09G 2300/0408* (2013.01); *G09G 2300/0819* (2013.01); *G09G 2310/0291* (2013.01)

(58) Field of Classification Search
CPC ..... G09G 3/20; G09G 2300/0408; G09G 2300/0819; G09G 2310/0291
See application file for complete search history.

(56) References Cited

U.S. PATENT DOCUMENTS

2013/0278586 A1* 10/2013 Kawano ..... G09G 5/001 345/212
2019/0080648 A1* 3/2019 Hwang ..... H01L 27/3244

FOREIGN PATENT DOCUMENTS

CN 101727866 A 6/2010
CN 103886844 A 6/2014
(Continued)

OTHER PUBLICATIONS

Chinese Office Action, dated Nov. 28, 2019, for HKC Corporation Limited, Chinese Application No. 201811484036.6, filed Dec. 5, 2018.

(Continued)

*Primary Examiner* — Chanh D Nguyen
*Assistant Examiner* — Ngan T. Pham-Lu
(74) *Attorney, Agent, or Firm* — Law Offices of Albert Wai-Kit Chan, PLLC

(57) ABSTRACT

Disclosed are a display panel and a display device. The display panel includes a substrate defining a display area, a fan-out area and a source driving chip. A feedback line is arranged in the display area. The source driving chip has a first state and a second state. When the source driving chip is in the first state, a first data signal is input by the source driving chip to the feedback line; when the source driving chip is in the second state, a voltage of the feedback line is fed back to the source driving chip, to allow the source driving chip to output a second data signal to a remaining line of the display area. In each column, a summed number of the first data signal is equal to a summed number of the second dpata signal.

19 Claims, 6 Drawing Sheets

(56) References Cited

FOREIGN PATENT DOCUMENTS

| | | | | |
|---|---|---|---|---|
| CN | 104678626 | A | | 6/2015 |
| CN | 104965339 | A | | 10/2015 |
| CN | 106531068 | | * | 3/2017 |
| CN | 106531068 | A | | 3/2017 |
| JP | 2015175860 | A | | 10/2015 |
| TW | 201251308 | A | | 12/2012 |

OTHER PUBLICATIONS

Chinese Office Action, dated Jun. 17, 2020, for HKC Corporation Limited, Chinese Application No. 201811484036.6, filed Dec. 5, 2018.

International Search Report, dated Sep. 12, 2019, for HKC Corporation Limited, International Application No. PCT/CN2018/122187, filed Dec. 19, 2018.

Written Opinion of International Search Authority, dated Sep. 12, 2019, for HKC Corporation Limited, International Application No. PCT/CN2018/122187, filed Dec. 19, 2018.

* cited by examiner

DISPLAY PANEL AND DISPLAY DEVICE

CROSS REFERENCE TO RELATED APPLICATIONS

The present application is the National Stage of International Application No. PCT/CN2018/122187, filed Dec. 19, 2018, which claims the priority to Chinese Patent Application No. 201811484036.6, filed Dec. 5, 2018 with the China National Intellectual Property Administration, and entitled "Display panel and display device", the entire contents of which are hereby incorporated by reference.

TECHNICAL FIELD

The present application relates to the technical field of display, in particular to a display panel and a display device.

BACKGROUND

The statements herein merely provide background information related to the present application and do not necessarily constitute prior art. As Thin Film Transistor-Liquid Crystal Display (TFT-LCD) tends to develop into a larger scale and a higher resolution, the product cost has become a more sensitive topic with the requirements of display quality and product maturity. To reduce the cost, it is one of the common methods to reduce the size of the border, that is, to increase the corresponding area of each Source IC. As shown in FIG. 1 to FIG. 3, the difference in tracing resistance and stray capacitance would become large by this way of fanning out, resulting in an inconsistency between the output voltage (i.e., Point A) of the operational amplifier of source driving chip (Source Driver OP) and the pixel voltage (Point B) supplied to the panel after passing through the fan-out area, which will leads to an uneven display of the display panel, and the color shift in the end.

SUMMARY

The main purpose of the present application is to provide a display panel, to avoid color shift and ensure the display uniformity of the display panel.

In order to achieve the above object, the display panel provided by the present application includes a substrate defining a display area, a fan-out area and a source driving chip. A feedback line is arranged in the display area. The source driving chip has a first state and a second state. When the source driving chip is in the first state, a first data signal is input by the source driving chip to the feedback line; when the source driving chip is in the second state, a voltage of the feedback line is fed back to the source driving chip, to allow the source driving chip to output a second data signal to a remaining line of the display area. In each column, a summed number of the first data signal is equal to a summed number of the second data signal.

Optionally, the source driving chip includes an operational amplifier, which further includes a first input end, a second input end and a first output end. The first output end is connected to the second input end, and the first output end is connected to the display area; and a voltage-to-current converting module, which includes a third input end connected to the first output end and a second output end connected to the second input end; and a switch unit and a controller, the controller is configured to control the switch unit to connect the first output end of the operational amplifier with the display area, when the source driving chip is in the first state; and control the switch unit to connect the display area, the voltage-to-current converting module, and the second input end of the operational amplifier, when the source driving chip is allowed to be in the second state.

Optionally, the switch unit includes a first switch and a second switch. The first switch is arranged between the first output end and the display area, and the second switch is arranged between the display area and the third input end of the voltage-to-current converting module. The source driving chip is in the first state, when the first switch is turned on and the second switch is turned off; the controller is a timer, when the timer reaches a preset time duration, the second switch is turned on, the first switch is turned off, and the source driving chip is allowed to be in the second state.

Optionally, the feedback line is configured with a black matrix and free of a color filter, to allow the feedback line as an invalid line.

Optionally, the black matrix being configured with the black matrix, is carried out by the following operations: setting a plurality of aligning marks on the substrate corresponding to the feedback line; providing a photoresist system of the black matrix, coating a photoresist system of the black matrix on a place of the substrate corresponding to the feedback line to form a photoresist layer. The photoresist layer covers the feedback line.

Optionally, a plurality of source lines and a plurality of gate lines are arranged in the display area, the source lines and the gate lines crossing to form a plurality of pixel units, and the pixel units in a first row of in the display area is set as the feedback line.

Optionally, the plurality of source lines divides the feedback line into the plurality of pixel units, and each of the pixel units is connected to the first output end of the operational amplifier.

Optionally, a plurality of fan-out wires are arranged in the fan-out area, one end of each of the fan-out wire being connected to the source driving chip, and the other end of each fan-out wire being connected to the source line. The fan-out wires are symmetrically arranged relative to the middle of the fan-out area along a length direction.

Optionally, a resistance of the fan-out wires increases upon approaching to middle of the fan-out area along the length direction.

The present application also provides a display device, which includes the display panel, further including:

a substrate defining a display area, a fan-out area and a source driving chip. A feedback line is arranged in the display area. The source driving chip has a first state and a second state. When the source driving chip is in the first state, a first data signal is input by the source driving chip to the feedback line; when the source driving chip is in the second state, a voltage of the feedback line is fed back to the source driving chip, to allow the source driving chip to output a second data signal to a remaining line of the display area. In each column, a summed number of the first data signal is equal to a summed number of the second data signal.

The present application provides a display panel, the display panel includes a substrate which further includes a display area, a fan-out area and a source driving chip, and a feedback line is arranged in the display area. The source driving chip has a first state and a second state. When the source driving chip is in the first state, a first data signal is input by the source driving chip to the feedback line. When the source driving chip is in the second state, a voltage of the feedback line is fed back to the source driving chip, and the source driving chip outputs a second data signal to a remaining line of the display area. The first data signal is configured opposite to the second data signal in size, to enable that in each column, a summed number of the first data signal is configured equal to a summed number of the second data signal. According to the present application, the substrate of the display panel is defined with the feedback line, and the source driving chip of the display panel has a first state and a second state. When the source driving chip is in the first state, the source driving chip can input the first data signal to the feedback line. Because of the delay in respect of the data line, size of the first data signal acting on the feedback line is not the same. As such, the pixel voltages at different positions in the feedback line are inconsistent. At this point, the source driving chip is switched to the second state, in which different pixel voltages can be fed back to the source driving chip, and the source driving chip may output the second data signal to the remaining lines of the display area. The size of the second data signal is set opposite to that of the first data signal. As such, the sum of the first data signal at different positions of the remaining rows can be set approximately equal to that of the second data signal. And pixel voltages at different positions of the remaining rows can be consistent, making the display of the display panel more uniform. The color shift can be avoided.

BRIEF DESCRIPTION OF THE DRAWINGS

In order to explain the embodiment of the present application or the technical solution of the prior art more clearly, the following will briefly introduce the drawings necessary in the description of the embodiments or the prior art. Obviously, the drawings in the following description are only some embodiments of the present application. For those ordinary skill in the art, other drawings can be obtained according to the structure shown in these drawings without any creative effort.

DETAILED DESCRIPTION OF THE EMBODIMENTS

Figure 1:
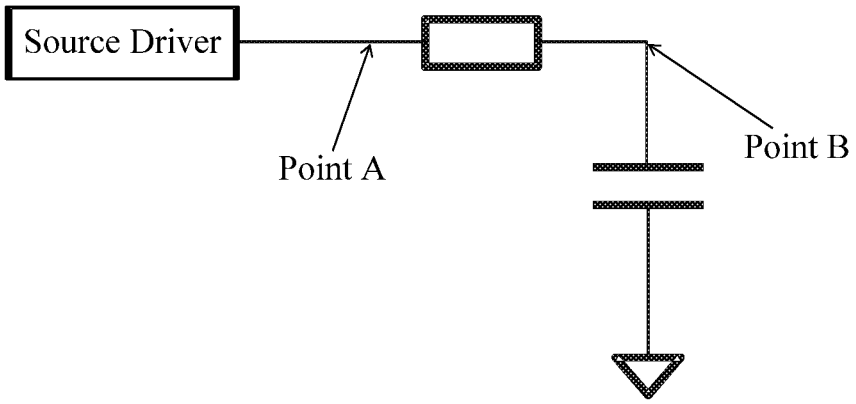
FIG. 1 is an exemplary schematic diagram of pixel voltages output by a source driving chip at different points.
Figure 2:
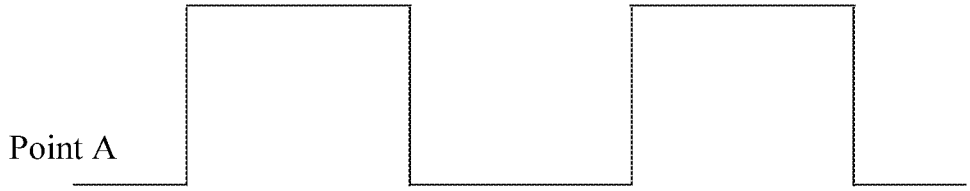
FIG. 2 is an oscillogram of pixel voltage at point A in FIG. 1.
Figure 3:
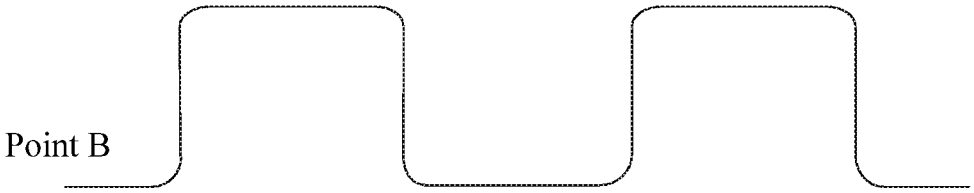
FIG. 3 is an oscillogram of pixel voltage at point B in FIG. 1.

As following, the technical solution in the embodiments of the present application will be described clearly and completely with reference to the drawings in the embodiment of the present application. Obviously, the described embodiment is only a part of the embodiment of the present application, not all of the embodiments. Based on the embodiments in the present application, all other embodiments perceived by those ordinary skills in the art without creative effort should be fallen within the protection scope of the present application.

It should be noted that if directional indications (such as up, down, left, right, front, back, etc.) are involved in the embodiments of the present application, the directional indications are only used to explain the relative positional relationship and movement between the components in a certain posture (as shown in the drawings), and if the specific posture changes, the directional indications will change accordingly.

In addition, if there are descriptions of "first" and "second" in the embodiments of this application, the descriptions of "first" and "second" are used for descriptive purposes only and cannot be understood as indicating or implying their relative importance or implicitly indicating the number of indicated technical features. Thus, features defining "first" and "second" may explicitly or implicitly include at least one such feature. In addition, the technical solutions between the various embodiments may be combined with each other, but must be based on what one of ordinary skill in the art can achieve. When the combination of technical solutions is contradictory or impossible to achieve, it should be considered that the combination of such technical solutions does not exist and is not within the protection scope required by the present application.

The present application provides a display panel, of which the pixel voltage is well behaved in consistency, and the display distribution of the display panel can thus be uniform.

Figure 4:
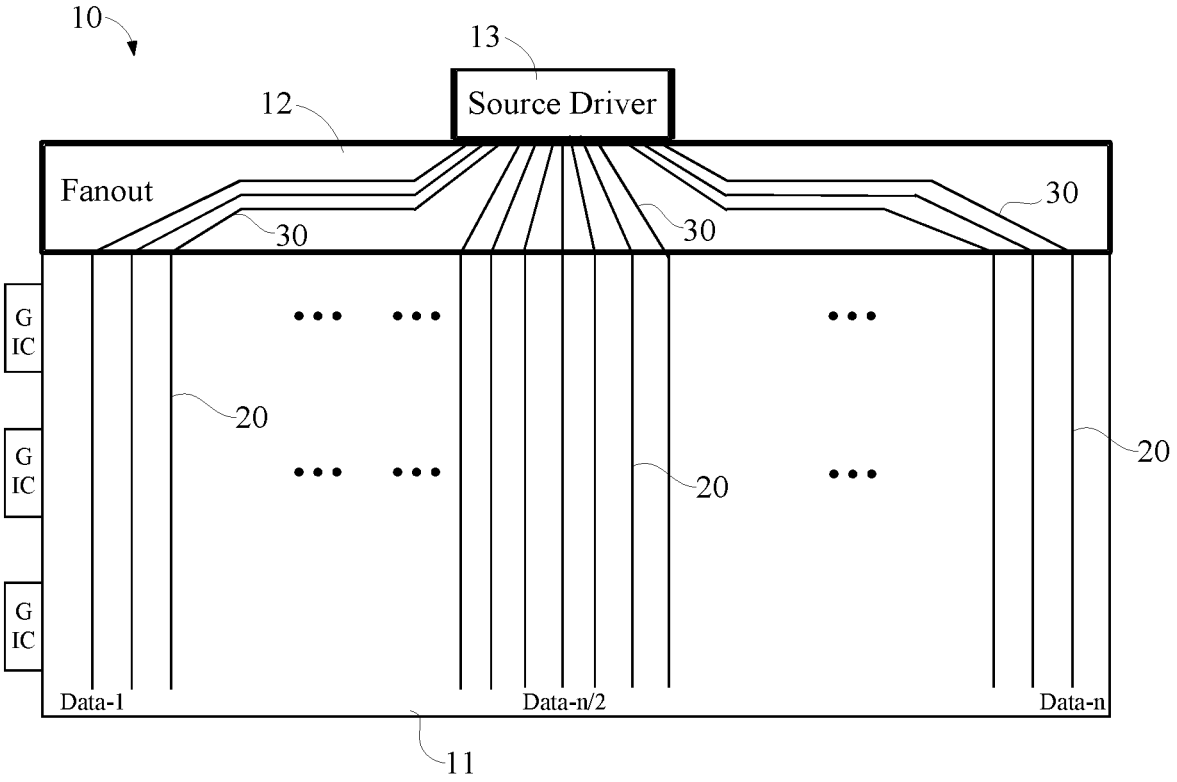
FIG. 4 is a schematic structural diagram of a display panel according to the present application.
Figure 5:
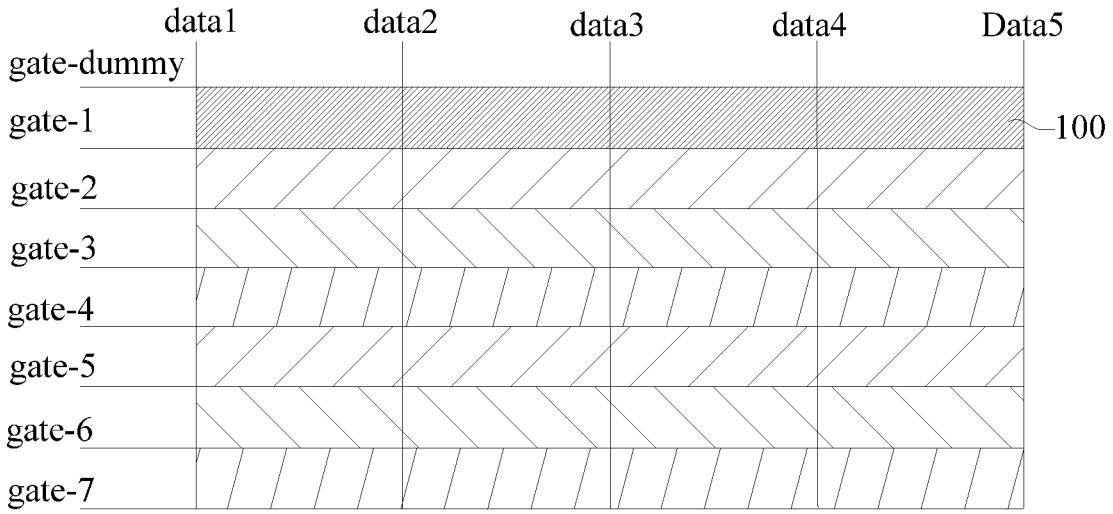
FIG. 5 is a schematic diagram of the display area in FIG. 1.

In some embodiments of the present application, as shown in FIGS. 4 and 5, the display panel includes a substrate 10 which further includes a display area 11, a fan-out area 12 and a source driving chip 13, and a feedback line 100 is arranged in the display area 11. The source driving chip 13 has a first state and a second state. When the source driving chip 13 is in the first state, a first data signal is input by the source driving chip 13 to the feedback line 100. When the source driving chip 13 is allowed to be in the second state, a voltage of the feedback line 100 is fed back to the source driving chip 13, and the source driving chip 13 outputs a second data signal to a remaining line of the display area 11. The first data signal is configured opposite to the second data signal in size, to enable that in each column, a summed number of the first data signal is configured equal to a summed number of the second data signal.

Specifically, the output signal of the source driving chip 13 (outputting data signal) and the output signal of the gate driving chip (outputting scanning signal) first and respectively pass through their respective fan-out circuits, and then are respectively transmitted to the array the pixel units of the display panel through the scanning line and the data line. The data line can be equivalent to a low-pass filter in the form of a first-order resistor and capacitor, thus leading to a delay effect on the signal (RC delay).

According to the present application, the substrate 10 of the display panel is defined with the feedback line 100, and the source driving chip 13 of the display panel has a first state and a second state. When the source driving chip 13 is in the first state, the source driving chip 13 can input the first data signal to the feedback line 100. Because of the delay in respect of the data line, size of the first data signal acting on the feedback line 100 is not the same. As such, the pixel voltages at different positions in the feedback line 100 are inconsistent. At this point, the source driving chip 13 is switched to the second state, in which different pixel voltages can be fed back to the source driving chip 13 which may output the second data signal to the remaining lines of the display area 11. The size of the second data signal is set opposite to that of the first data signal. As such, the sum of the first data signal at different positions of the remaining rows can be set approximately equal to that of the second data signal. And pixel voltages at different positions of the remaining rows can be consistent, making the display of the display panel more uniform. The color shift can be avoided.

Figure 6:
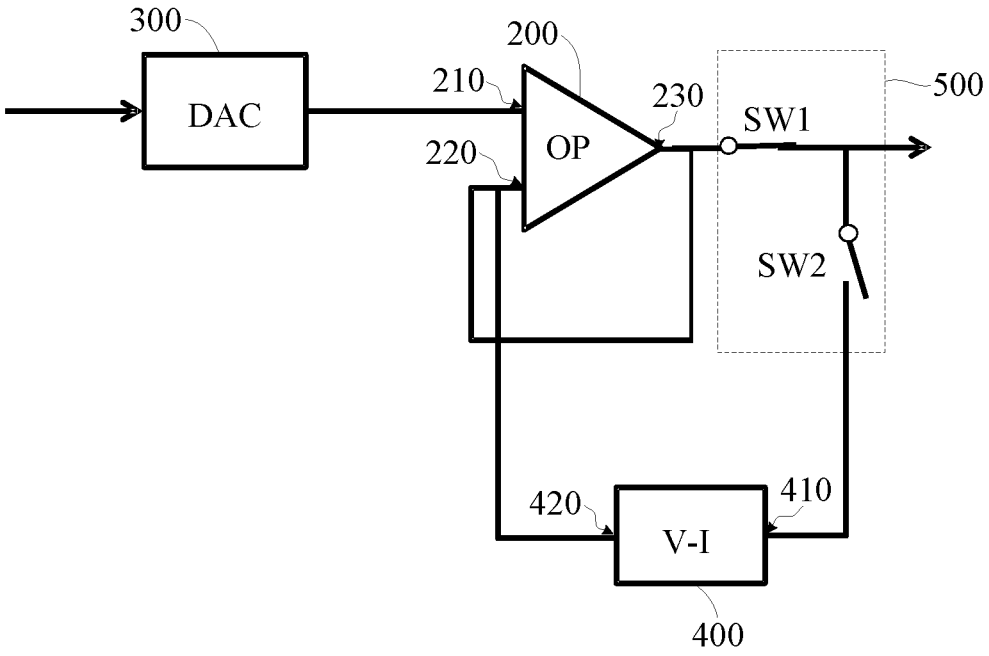
FIG. 6 is a schematic diagram showing a first state of the source driving chip of FIG. 1.
Figure 7:
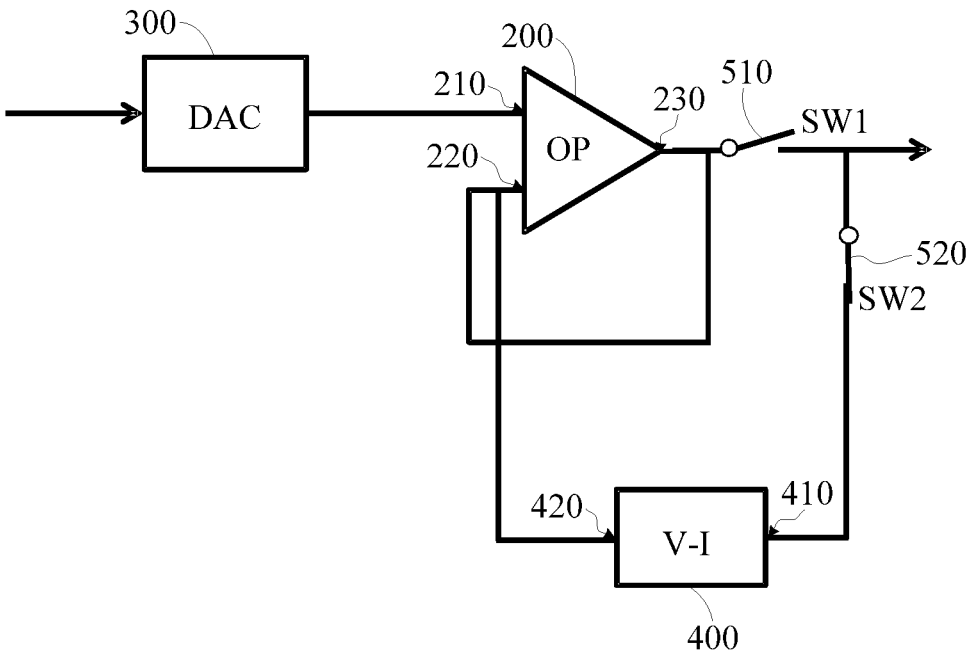
FIG. 7 is a schematic diagram showing a second state of the source driving chip of FIG. 1.

Optionally, as shown in FIGS. 6 and 7, the structure of the source driving chip 13 will be described in detail. In some embodiments, the source driving chip 13 includes an operational amplifier 200, a digital-to-analog converting module 300, a voltage-to-current converting module 400, a switching unit 500, and a controller (not shown in the figures). The operational amplifier 200 has a first input 210, a second input 220, and a first output 230. The first output 230 is connected to the second input 220, and the first output 230 is configured to connect to the display area 11. The digital-to-analog converting module 300 is connected to the first input 210. The voltage-to-current converting module 400 has a third input 410 connected to the first output 230 and a second output 420 connected to the second input 220. The controller is configured to control the switch unit 500 to connect the first output end 230 of the operational amplifier 200 and the display area 11, when the source driving chip 13 is in the first state, and control the switch unit 500 to connect the display area 11, the voltage-to-current converting module 400 and the second input end 220 of the operational amplifier 200, when the source driving chip 13 is allowed to be in the second state.

Specifically, in some embodiments, the voltage-to-current converting module 400 has a high voltage input and a low current output; or a low voltage input, and a high current output. As such, the power of the operational amplifier 200 can be changed. A low current in the area with the high pixel voltage is converted by the voltage-to-current converting module 400 and acts on the operational amplifier 200. At such moment, the power of the operational amplifier 200 is low and charge the area with high pixel voltage slowly. To the opposite, a high current in the area with the low pixel voltage is converted by the voltage-to-current converting module 400 and acts on the operational amplifier 200. At such moment, the power of the operational amplifier 200 is high and charge the area with high pixel voltage quickly. As such, the pixel voltages in different areas tends to be consistent, improving the uniformity of the display of the display screen.

Optionally, referring to FIGS. 6 and 7, the structure of the switch unit 500 and the controller will now be described in detail. In some embodiments, the switch unit 500 includes a first switch 510 and a second switch 520. The first switch 510 is arranged between the first output end 230 and the display area 11, and the second switch 520 is arranged between the display area 11 and the third input end 410 of the voltage-to-current converting module 400. The source driving chip 13 is in the first state, when the first switch 510 is turned on and the second switch 520 is turned off; the controller is a timer, when the timer times a preset time duration, the second switch 520 is turned on, the first switch 510 is turned off, and the source driving chip 13 is allowed to be in the second state.

Specifically, in the feedback line 100 before the normal display area 11, the first switch 510 is turned on and the second switch 520 is turned off to charge the display panel. Through the timer, when the charging time reaches the preset time duration T, the first switch 510 is turned off and the second switch 520 is turned on to connect the pixel voltage with the voltage-to-current converting module 400 if the source driving chip 13. Since the signals in fan-out area 12 are delayed, resulting in an inconsistency in pixel voltages. The turning on of the first switch 510, and turning off of the second switch 520, would feed the pixel voltage back to the voltage-to-current converting module 400 of the source driving chip 13. The voltage-to-current converting module 400 provides different reference currents (I_REF) under different pixel voltages. The larger the pixel voltage input by the voltage-to-current converting module 400, the smaller the reference current output. As the larger the resistance of the fan-out area 12, the smaller the pixel voltage, that is, the larger the reference current output by the voltage-to-current converting module 400. With the increase of the internal reference current of the source driving chip 13, the driving capability of the source driving chip 13 increases, that is, the driving capability of the operational amplifier 200 inside the source driving chip 13 is stronger. And the consistency in pixel voltage at different positions can be achieved, therefore solving uniform display of the display panel.

Optionally, the position of the feedback line 100 will be described. In some embodiments, a plurality of source lines 20 and a plurality of gate lines are arranged in the display area 11, the source lines 20 and the gate lines crossing to form a plurality of pixel units, and the pixel units in a first row of in the display area 11 is set as the feedback line 100.

Specifically, the plurality of source lines 20 and the plurality of gate lines cross to form a plurality of pixel units. Taking the first row of pixel units as an example, the first row of pixel units is divided into a plurality of sub-areas by the plurality of source lines 20, and each sub-area is connected to the output end of one operational amplifier 200. Due to different initial pixel voltages in different sub-areas, the pixel voltages fed back by the operational amplifiers 200 corresponding to different sub-areas are different, so that the pixel voltages of different sub-areas can be made uniform, and the display uniformity of the display panel can be improved.

Optionally, the feedback line 100 is to detect pixel voltages of different sub-areas, so the feedback line 100 does not need to display colors, so in some embodiments, the feedback line 100 is configured free of color filter. Specifically, all pixel units except the feedback line 100 are provided with color filters, and each row of pixel units is set as a same color. The feedback line 100 is the first row among pixel units. Therefore, different colors can be displayed on the pixel units, while the feedback line 100 is configured free of color filter, the cost of the display panel can be significantly reduced.

In some embodiments, as shown in FIG. 5, the feedback line 100 adopts the design of a black matrix. The black matrix can shield light and avoid the backlight from flowing. Thus, even if the pixel voltage is not uniform at the beginning, the normal display of the display panel will not be affected.

In a conventional liquid crystal display panel, a layer of Black Matrix (BM, black matrix) is usually made at one side of the color film substrate 10, and the black matrix is configured to divide adjacent color resistances, and block color gaps, to prevent light leakage or color mixing. However, the technology of preparing black matrix on TFT array substrate 10 is called BM On Array (BOA, black matrix attached to array substrate 10). BOA can solve the problem of mismatching of light shielding areas due to the misalignment of upper and lower substrates 10. In some embodiments, the feedback line 100 is configured free of color filter, and the feedback line 100 is designed with a black matrix, so the normal display of the display screen will not be affected regardless of the voltage.

Specifically, the manufacturing operations of the black matrix are: Step 1, setting a plurality of aligning marks on the substrate 10 corresponding to the feedback line 100; Step 2, providing a black matrix photoresist system, coating the black matrix photoresist system on place of the substrate 10 corresponding to the feedback line 100 to form a photoresist layer. The photoresist layer covers the feedback line 100. The black matrix photoresist system at least includes two components: negative photo resist and metal halide. The metal halide is a low optical density material when not exposed to light, so that the photoresist layer is transparent when not exposed to light; Step 3, after accurate alignment using aligning marks, the photoresist layer is exposed through a photomask according to the design pattern of the black matrix. The metal halide in the photo-resist layer in the photo-exposure area decomposes to metal particles, so that the photo-resist layer in the photo-exposure area appears black, and the photo-resist layer in the photo-exposure area becomes insoluble in developer; Step 4, developing the photoresist layer to remove the photoresist layer in the un-illuminated area blocked by the photomask, and to obtain a black matrix.

Optionally, FIG. 4 is referred to. In order to optionally improve the uniformity of the display effect of the display panel, in some embodiments of the present application, a plurality of fan-out wires 30 are arranged in the fan-out area 12, one end of the fan-out wires 30 are connected to the source driving chip 13, and the other end of the fan-out wires 30 are connected to the source wires 20. The fan-out wires 30 are symmetrically arranged about the middle of the fan-out area 12 along the length direction. Since the fan-out wires 30 are symmetrically arranged about the middle of the fan-out area 12 along the length direction, the signal delay effects on both sides of the fan-out area 12 can be made similar, improving the uniformity of the display effect of the display panel.

In some embodiments, considering that the length of the fan-out wires 30 gradually increases when going far away from the middle of the fan-out area 12, the longer the length of the fan-out wires 30, the stronger the signal delay of the fan-out wires 30. In order to make the delay effect of the fan-out wires 30 at symmetric positions to be similar, in some embodiments of the present application, the resistance of the fan-out wires 30 is configured to increase from the middle along the length direction near the fan-out area 12. The length of the fan-out wires 30 near the middle of the fan-out area is short. And the longer the length of the fan-out wires 30, the greater the resistance of the fan-out wires 30, and the stronger the signal delay effect of the fan-out wires 30. The fan-out wires 30 having a shorter length is configured to have a larger resistance, enabling the delay of the fan-out wires 30 at different positions to be similar, thereby optionally improving the display uniformity of the display panel.

The present application further provides a display device, which includes the display panel whose specific structure can be referred to the aforementioned embodiments. Since the display device provided in the present application adopts all the technical solutions of the above embodiments, it has at least all the advantages brought by the technical solutions of the above embodiments and will not be repeated herein. Specifically, the display device may be, but not limited to, television, display, etc. Specifically, in some embodiments, the display device is a liquid crystal display. In other embodiments, the display device may also be an OLED display (Organic Light-Emitting Diode display) or the like.

The description aforementioned is only the preferred embodiment of the present application and is not intended to limit the scope of the present application. Any equivalent structural modification made by using the description and drawings of the present application or direct/indirect application in other related technical fields under the concept of the present application shall be included in the protection scope of the present application.

What is claimed is:

1. A display panel comprising:

a substrate, defining a display area, a fan-out area and a source driving chip; a feedback line being defined in the display area;

the source driving chip having a first state and a second state; wherein when the source driving chip is in the first state, a first data signal is input by the source driving chip to the feedback line; when the source driving chip is in the second state, a voltage of the feedback line is fed back to the source driving chip, to allow the source driving chip to output a second data signal to a remaining line of the display area, wherein in each column, a summed number of the first data signal input by the source driving chip is equal to a summed number of the second data signal input by the source driving chip.

2. The display panel of claim 1, wherein the source driving chip comprises:

an operational amplifier, comprising a first input end, a second input end, and a first output end, wherein the first output end is connected to the second input end, and the first output end is connected to the display area;

a digital-to-analog converting module, connected to the first input end;

a voltage-to-current converting module, comprising a third input end connected to the first output end and a second output end connected to the second input end; and a switch unit and a controller, the controller being configured to control the switch unit to connect the first output end of the operational amplifier with the display area when the source driving chip is in the first state, and control the switch unit to connect the display area, the voltage-to-current converting module, and the second input end of the operational amplifier, when the source driving chip is in the second state.

3. The display panel of claim 2, wherein, the switch unit comprises a first switch and a second switch, the first switch being arranged between the first output end and the display area, and the second switch being arranged between the display area and the third input end of the voltage-to-current converting module; wherein the source driving chip is in the first state, when the first switch is turned on and the second switch is turned off; the controller is a timer, when the timer timing a preset time duration, the second switch is turned on, the first switch is turned off, and the source driving chip is allowed to be in the second state.

4. The display panel of claim 2, wherein the feedback line is configured with a black matrix and free of a color filter, to allow the feedback line as an invalid line.

5. The display panel of claim 4, wherein the black matrix being configured with the black matrix, is carried out by operations comprising:

setting a plurality of aligning marks on the substrate corresponding to the feedback line; and providing a photoresist system of the black matrix, coating a photoresist system of the black matrix on a place of the substrate corresponding to the feedback line to form a photoresist layer, wherein the photoresist layer covers the feedback line.

6. The display panel of claim 2, wherein a plurality of source lines and a plurality of gate lines are arranged in the display area, the source lines and the gate lines crossing to form a plurality of pixel units, the pixel units in a first row of the display area being set as the feedback line.

7. The display panel of claim 6, wherein the plurality of source lines divide the feedback line into the plurality of pixel units, each of the pixel units being connected to the first output end of the operational amplifier.

8. The display panel of claim 6, wherein a plurality of fan-out wires are arranged in the fan-out area, one end of each of the fan-out wire being connected to the source driving chip, and the other end of each fan-out wire being connected to the source line; and the fan-out wires are symmetrically arranged relative to the middle of the fan-out area along a length direction.

9. The display panel of claim 8, wherein a resistance of the fan-out wires increases upon approaching to the middle of the fan-out area along the length direction.

10. The display panel of claim 1, wherein the feedback line is configured with a black matrix and free of a color filter, to allow the feedback line as an invalid line.

11. The display panel of claim 10, wherein the feedback line being configured with a black matrix, is carried out by operations comprising:

setting a plurality of aligning marks on the substrate corresponding to the feedback line; and providing a photoresist system of the black matrix, coating a photoresist system of the black matrix on a place of the substrate corresponding to the feedback line to form a photoresist layer, wherein the photoresist layer covers the feedback line.

12. The display panel of claim 1, wherein a plurality of source lines and a plurality of gate lines are arranged in the display area, the source lines and the gate lines crossing to form a plurality of pixel units, the pixel units in a first row of the display area being set as the feedback line.

13. The display panel of claim 12, wherein a plurality of fan-out wires are arranged in the fan-out area, one end of each of the fan-out wires being connected to the source driving chip, the other end of each fan-out wire being connected to the source line;

the fan-out wires are symmetrically arranged relative to the middle of the fan-out area along a length direction.

14. The display panel of claim 13, wherein a resistance of the fan-out wires increases upon approaching to the middle of the fan-out area along the length direction.

15. A display device, wherein the comprising a display panel, the display panel comprising:

a substrate, defining a display area, a fan-out area and a source driving chip; a feedback line being defined in the display area;

the source driving chip having a first state and a second state; wherein when the source driving chip is in the first state, a first data signal is input by the source driving chip to the feedback line; when the source driving chip is in the second state, a voltage of the feedback line is fed back to the source driving chip, to allow the source driving chip to output a second data signal to a remaining line of the display area, wherein in each column, a summed number of the first data signal input by the source driving chip is equal to a summed number of the second data signal input by the source driving chip.

16. The display device of claim 15, wherein the source driving chip comprises:

an operational amplifier, comprising a first input end, a second input end and a first output end, wherein the first output end is connected to the second input end, and the first output end is connected to the display area;

a digital-to-analog converting module, connected to the first input end;

a voltage-to-current converting module, comprising a third input end connected to the first output end and a second output end connected to the second input end; and a switch unit and a controller, the controller being configured to control the switch unit to connect the first output end of the operational amplifier with the display area, when the source driving chip is in the first state; and control the switch unit to connect the display area, the voltage-to-current converting module, and the second input end of the operational amplifier, when the source driving chip is allowed to be in the second state.

17. The display device of claim 16, wherein, the switch unit comprises a first switch and a second switch, wherein the first switch is arranged between the first output end and the display area, and the second switch is arranged between the display area and the third input end of the voltage-to-current converting module; wherein the source driving chip is in the first state, when the first switch is turned on and the second switch is turned off; the controller is a timer, when the timer timing a preset time duration, the second switch is turned on, the first switch is turned off, and the source driving chip is allowed to be in the second state.

18. The display device of claim 15, wherein the feedback line is configured with a black matrix and free of a color filter, to allow the feedback line as an invalid line.

19. The display device of claim 15, wherein a plurality of source lines and a plurality of gate lines are arranged in the display area, the source lines and the gate lines crossing to form a plurality of pixel units, the pixel units in a first row of the display area being set as the feedback line.

* * * * *